US011735867B2

(12) United States Patent
Chen

(10) Patent No.: US 11,735,867 B2
(45) Date of Patent: Aug. 22, 2023

(54) ELECTRICAL CONNECTOR HAVING A SHIELDING PLATE LOCATED BETWEEN A PAIR OF HOLDING MEMBERS

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Ming-Ching Chen, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 799 days.

(21) Appl. No.: 16/727,912

(22) Filed: Dec. 26, 2019

(65) Prior Publication Data

US 2020/0212635 A1 Jul. 2, 2020

(30) Foreign Application Priority Data

Dec. 28, 2018 (CN) ..... 201822228360.3

(51) Int. Cl.

| | |
|---|---|
| ***H01R 13/6585*** | (2011.01) |
| ***H01R 13/6471*** | (2011.01) |
| ***H01R 13/405*** | (2006.01) |
| ***H01R 12/73*** | (2011.01) |
| ***H01R 12/71*** | (2011.01) |

(52) U.S. Cl.

CPC ..... *H01R 13/6585* (2013.01); *H01R 12/716* (2013.01); *H01R 12/73* (2013.01); *H01R 13/405* (2013.01); *H01R 13/6471* (2013.01)

(58) Field of Classification Search

CPC .. H01R 13/20; H01R 13/6585; H01R 12/716; H01R 13/405; H01R 13/6471; H01R 12/73

See application file for complete search history.

(56) References Cited

U.S. PATENT DOCUMENTS

| | | | | |
|---|---|---|---|---|
| 6,764,315 | B2 * | 7/2004 | Ng | H01R 12/714 439/607.05 |
| 7,585,185 | B2 * | 9/2009 | Obikane | H01R 12/716 439/74 |
| 9,124,011 | B2 * | 9/2015 | Miyazaki | H01R 13/6271 |
| 9,350,097 | B2 * | 5/2016 | Yunoki | H01R 12/716 |
| 10,446,985 | B2 * | 10/2019 | Ooi | H01R 13/6597 |
| 11,075,475 | B2 * | 7/2021 | Chen | H01R 13/6585 |
| 2018/0358729 | A1 | 12/2018 | Chen | |

FOREIGN PATENT DOCUMENTS

TW 201826644 A 7/2018

* cited by examiner

*Primary Examiner* — Edwin A. Leon
(74) *Attorney, Agent, or Firm* — Ming Chieh Chang

(57) ABSTRACT

An electrical connector includes an insulative housing defining a receiving space, plural contacts secured to the insulative housing and exposed to the receiving space, a first and second holding members secured to two opposite ends of the insulative housing and exposed to the receiving space, and a shielding plate located between the first and second holding members, wherein at least one of the first and second holding members has an integral coupling parallel to the shielding plate.

18 Claims, 13 Drawing Sheets

ELECTRICAL CONNECTOR HAVING A SHIELDING PLATE LOCATED BETWEEN A PAIR OF HOLDING MEMBERS

BACKGROUND OF THE INVENTION

1. Field of the Invention

The present invention relates to an electrical connector comprising an insulative housing, a plurality of contacts secured to the insulative housing, a first and second holding members secured to two opposite ends of the insulative housing, and a shielding plate located between the first and second holding members.

2. Description of Related Art

U.S. Patent Application Publication No. 2018/0358729 discloses an electrical connector comprising an insulative housing defining a receiving space, a plurality of contacts secured to the insulative housing and exposed to the receiving space, and a first and second holding members secured to two opposite ends of the insulative housing and exposed to the receiving space. Each holding member has two separate parts.

U.S. Pat. No. 10,446,985 discloses a similar electrical connector further including a shielding plate located between a first and second holding members thereof, wherein each of the first and second holding members has an integral coupling portion connected to the shielding plate.

SUMMARY OF THE INVENTION

An electrical connector includes an insulative housing defining a receiving space, plural contacts secured to the insulative housing and exposed to the receiving space, a first and second holding members secured to two opposite ends of the insulative housing and exposed to the receiving space, and a shielding plate located between the first and second holding members, wherein at least one of the first and second holding members has an integral coupling parallel to the shielding plate.

DETAILED DESCRIPTION OF THE PREFERRED EMBODIMENT

Figure 1:
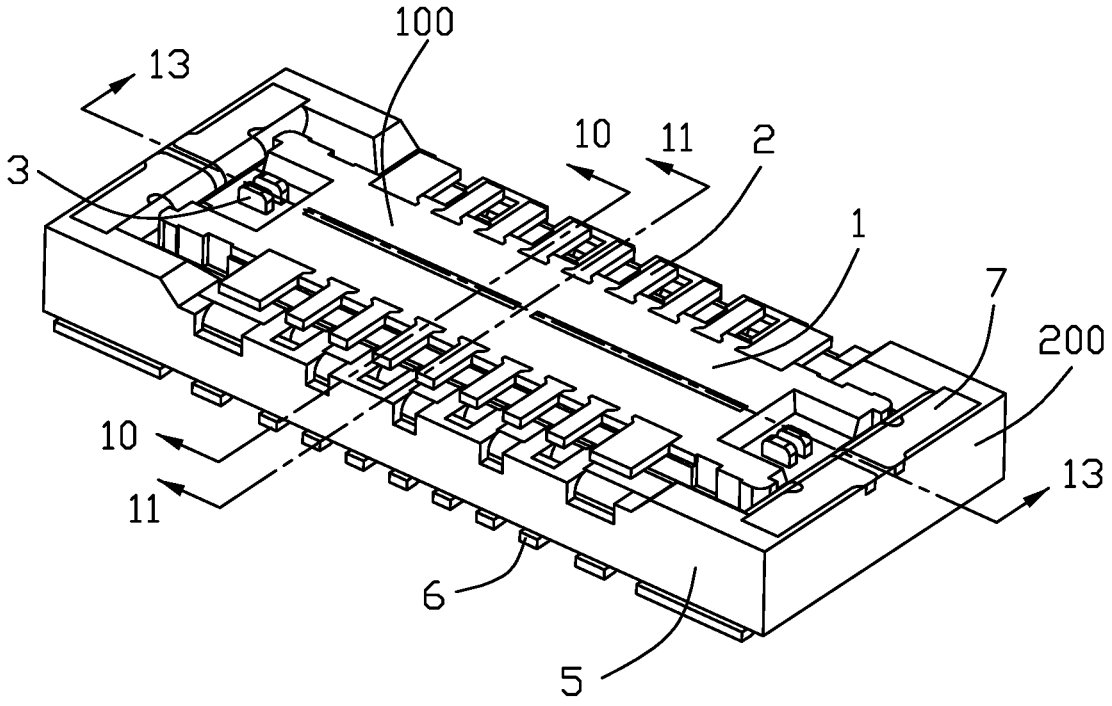
FIG. 1 is a perspective view of an electrical connector assembly in accordance with the present invention.
Figure 2:
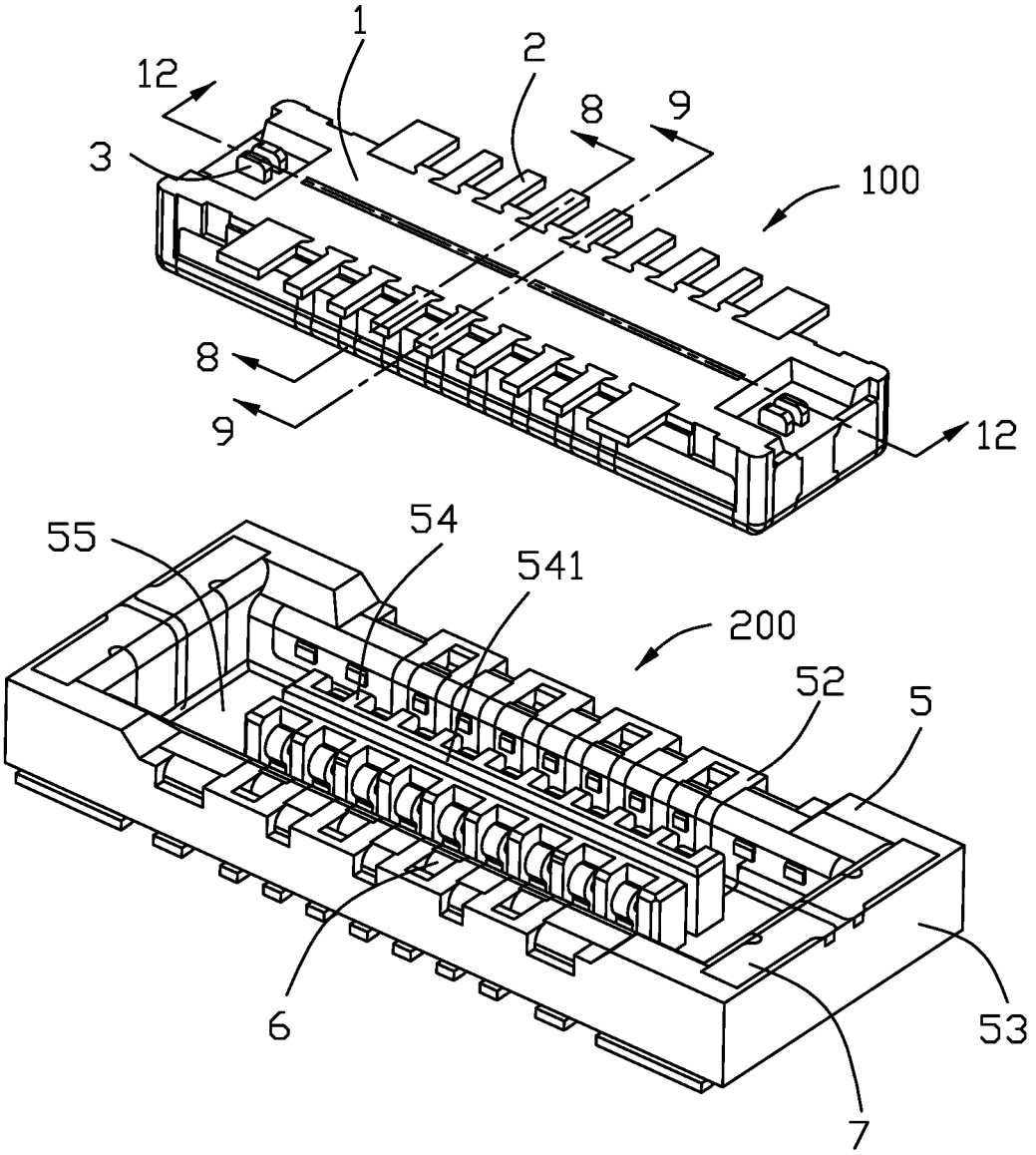
FIG. 2 is a perspective view of a plug connector and a receptacle connector of the electrical connector assembly.
Figure 3:
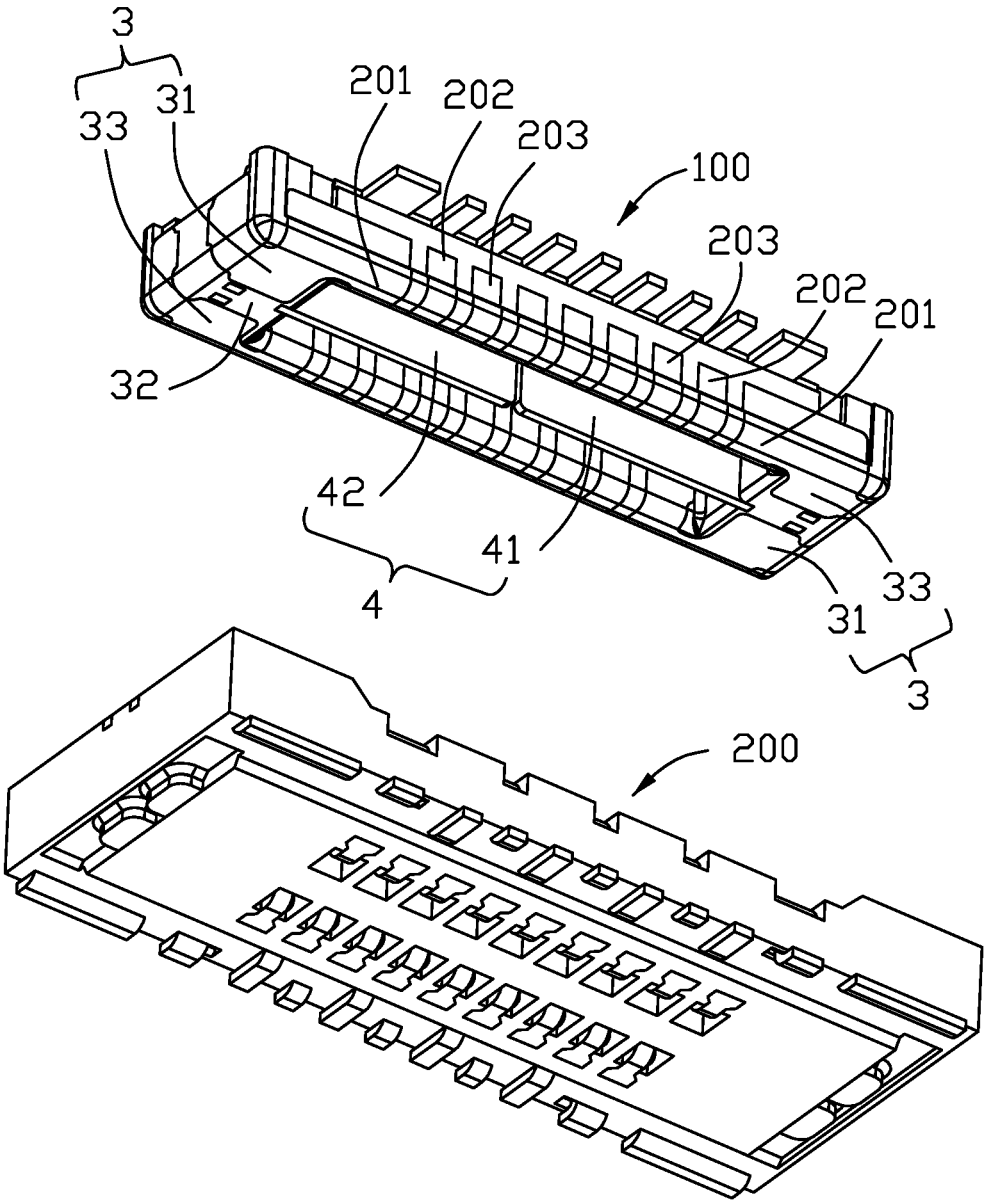
FIG. 3 is another perspective view of the plug connector and the receptacle connector.

Referring to FIGS. 1-13, an electrical connector assembly includes a plug connector 100 and a mating receptacle connector 200.

Referring to FIGS. 2-5, the plug connector 100 includes an elongate insulative housing 1, a plurality of contacts 2 secured (e.g., insert molded) to the insulative housing, and a pair of holding members 3 secured to two opposite ends of the insulative housing. The housing 1 defines a longitudinal direction X, a transverse direction Y and a vertical direction Z perpendicular to one another.

The insulative housing 1 has a bottom wall 11 and a peripheral wall formed by a pair of side walls 12 along a lengthwise direction and a pair of end walls 13 along a widthwise direction. The insulative housing 1 therefore defines a receiving space 14.

The plurality of contacts 2 are arranged in two rows and each of the contacts 2 has a generally U-shaped part, consisting of a base 20 and two contacting limbs 21, and a soldering part 22. The outer limb has a recess 210. The inner limb is exposed to the receiving space 14 and the outer limb is exposed to an outside. Each row of contacts 2 include two outer ground contacts 201 and plural inner contacts therebetween arranged consecutively as signal contacts 202 and ground contacts 203.

Each of the pair of ground contacts 201 is similarly structured as the contact 20 but has a larger width. Moreover, each ground contact 201 is integral with an adjacent holding member 3. To shield between the two rows of contacts, a shielding plate 4 is provided. The shielding plate 4 has plural holes 40. The shielding plate 4 is coupled to at least one of the two holding members 3.

The shielding plate 4 is generally planar and may be constructed as a first shield 41 and a second shield 42 lying on a same plane along the lengthwise direction. Each holding member 3 may be constructed as a first part 31 and a second part 33 separated by a gap 32. Each of the first part 31 and the second part 33 has an integral coupling portion 34. The coupling portion 34 is vertically oriented to be parallel with the shielding plate 4. In the embodiment shown, the shielding plate 4 is coplanar with the coupling portion 34. One of the first and second parts 31 and 33 is wider than the other so that the associated coupling portion 34 and therefore the shielding plate 4 is centered with respect to the two rows of contacts 2.

Referring to FIGS. 2-3 and 6-7, the receptacle connector 200 includes an elongate insulative housing 5, a plurality of contacts 6, and a shielding shell 7 secured (e.g., insert molded) to the insulative housing. The insulative housing 5 has a bottom wall 51, a pair of side walls 52 along a lengthwise direction, a pair of end walls 53 along a widthwise direction, and an island 54. The insulative housing 5 therefore defines a receiving space or cavity 55. The island 54 has a slot or receiving slit 541. The plurality of contacts 6 are arranged in two rows and each of the contacts 6 is a signal contact 61. The shielding shell 7 includes a pair of side parts 71 and a pair of end parts 72. Each side part 71 has plural ground contacts 711 arranged consecutively with the signal contacts 61 and located further outwardly of the signal contacts.

Each signal contact 61 has a bottom 610, an inverted U-shaped securing part 611, a contacting part 612, and a soldering part 613. The securing part 611 has a protrusion 6110. Each ground contact 711 has a bottom 7110, an inverted U-shaped securing part 7111, a contacting part 7112, and a soldering part 7113. The securing part 7111 has a protrusion 71110. The plural ground contacts 711 of each side part 71 include two outer contacts 712 and plural inner contacts 713 therebetween. The outer contact 712 has a greater lengthwise dimension than either one of the inner contact 713 and the signal contact 61.

Each end part 72 of the shielding shell 7 has may be constructed as two separate portions 721. Each portion 721 has a top wall 7211 and an inner wall 7212. The inner wall 7212 has a soldering leg 7213. The top wall 7211 is integrally connected with the side part 71.

Compared with the traditional arrangement disclosing the receptacle connector self-equipped with a metallic shielding plate unitarily formed with the corresponding holding member and embedded within a center island of its own insulative housing, in the instant invention the plug connector provides the metallic shielding plate unitarily formed with the corresponding holding member so as to be inserted into the receiving slit formed within the center island of the receptacle connector. Therefore, the mechanical coupling between the plug connector and the receptacle connector occurs at the two side walls and the center island simultaneously in the invention advantageously, compared with the traditional arrangement disclosing such mechanical coupling occurring at only two side walls without the center island.

Figure 4:
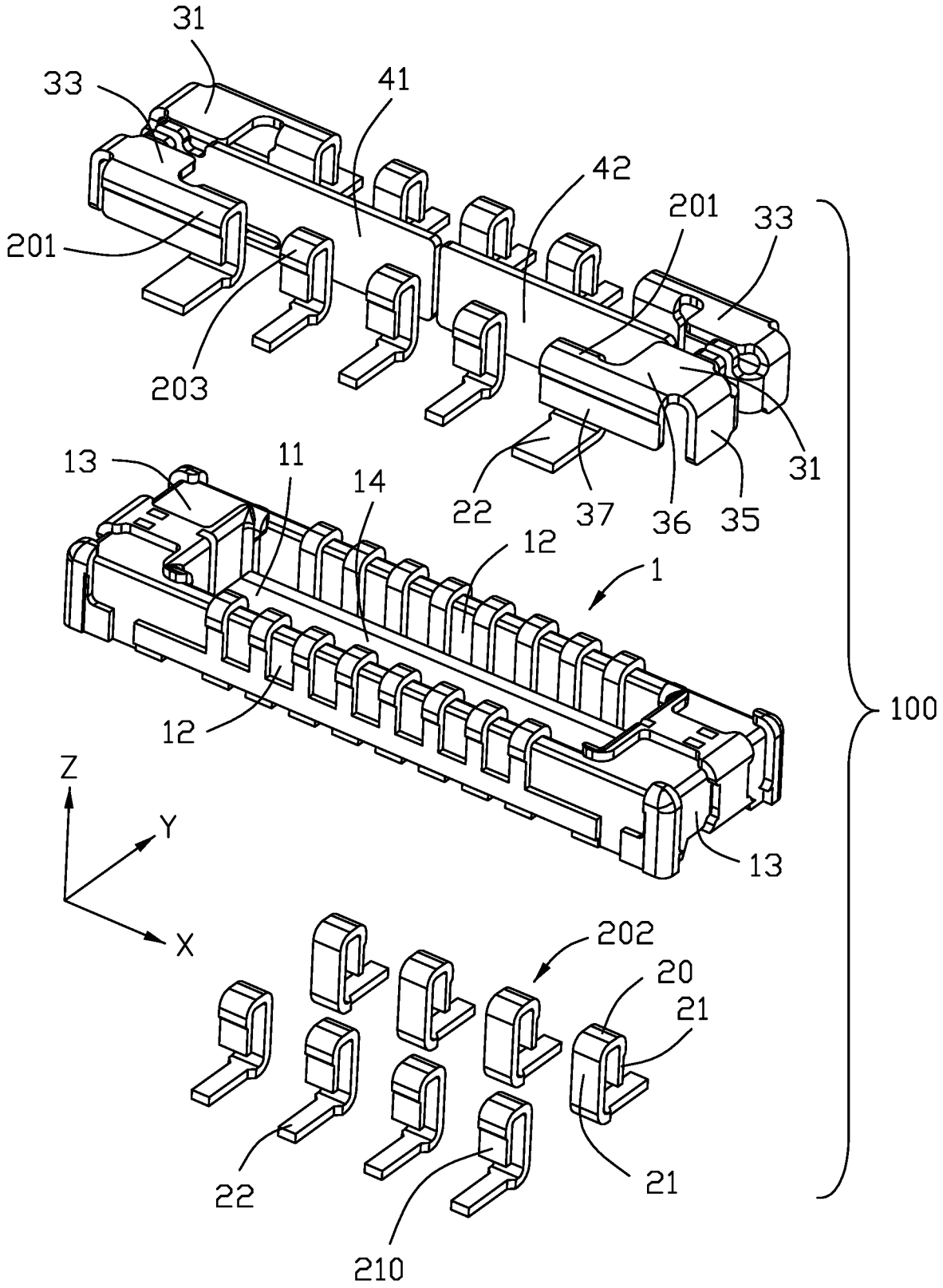
FIG. 4 is an exploded view of the plug connector.
Figure 5:
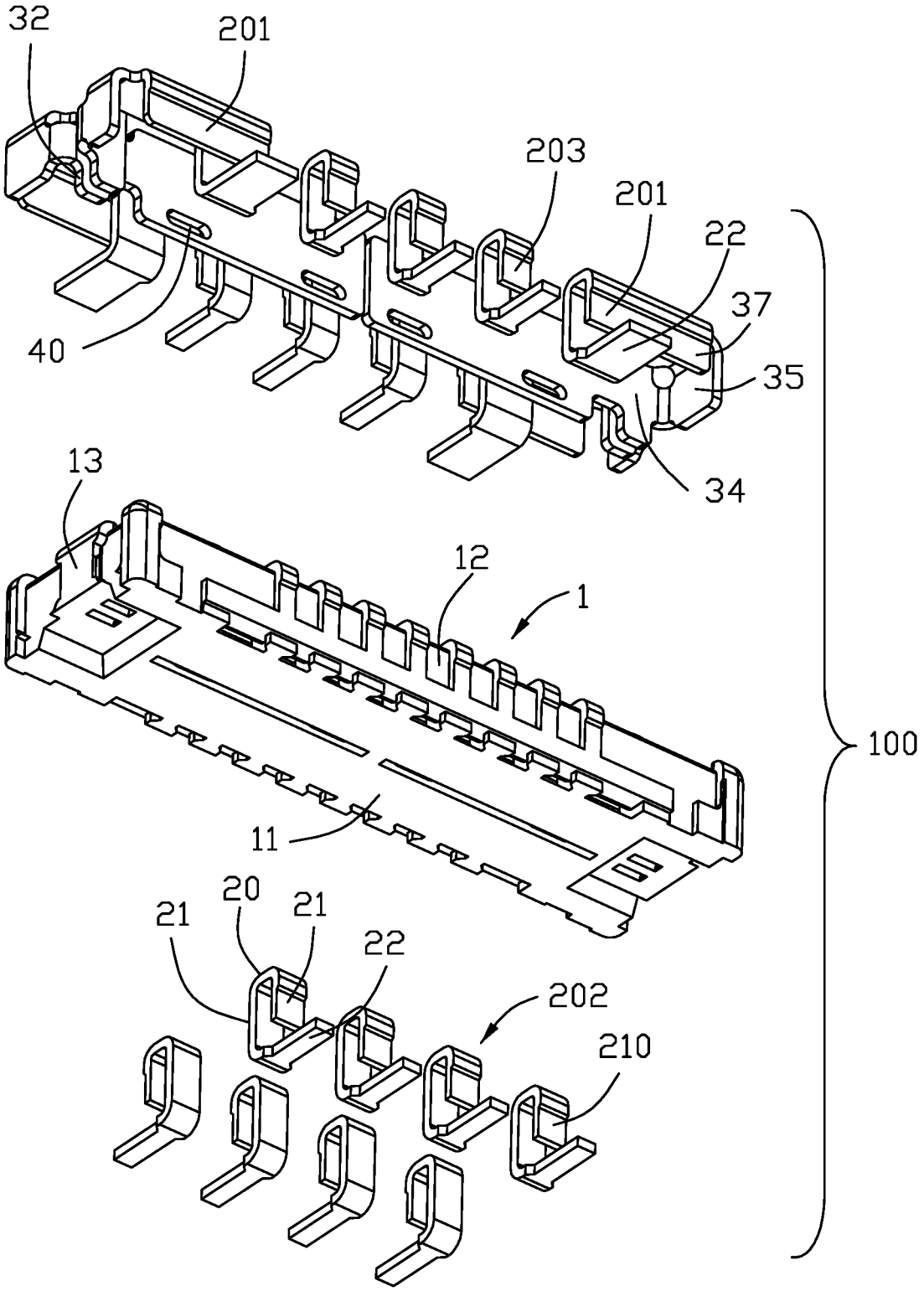
FIG. 5 is another exploded view of the plug connector.
Figure 6:
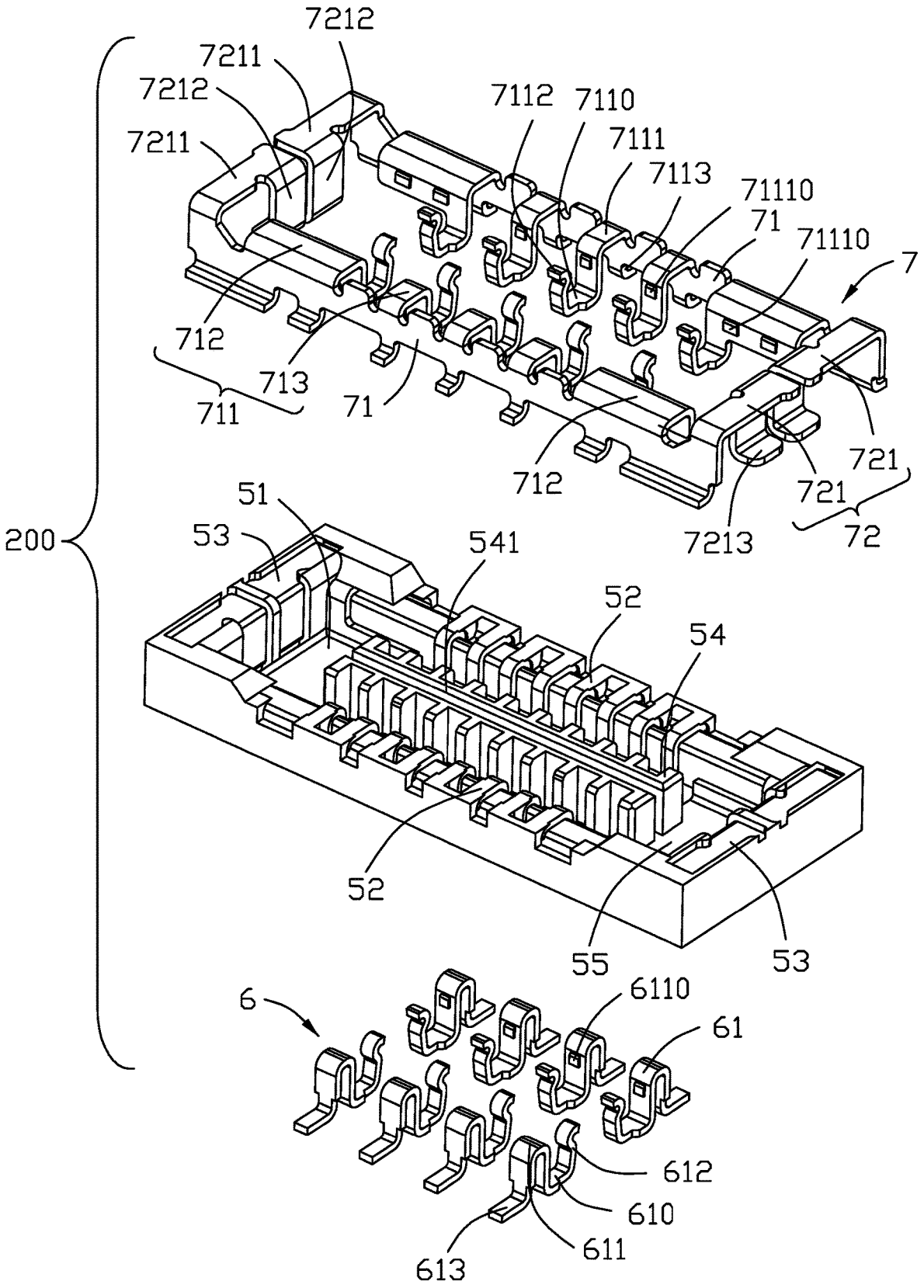
FIG. 6 is an exploded view of the receptacle connector.
Figure 7:
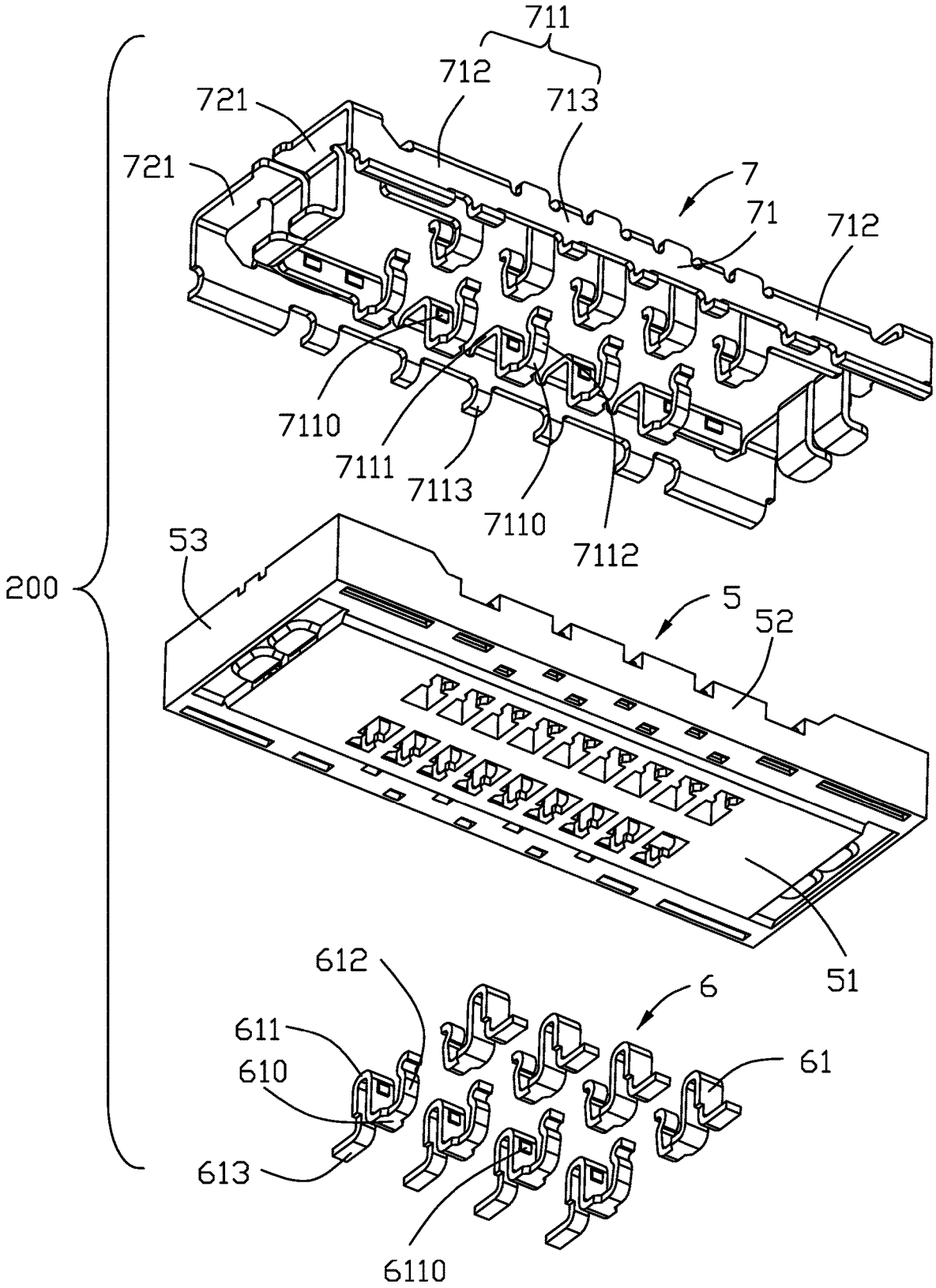
FIG. 7 is another exploded view of the receptacle connector.
Figure 8:
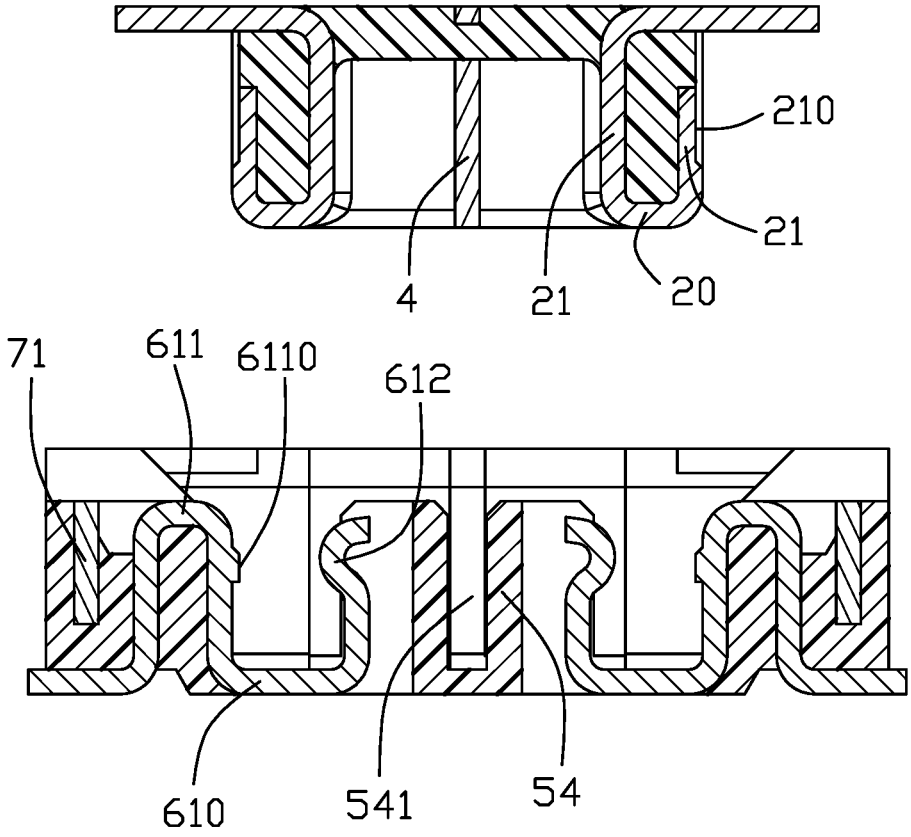
FIG. 8 is a cross-sectional view of the electrical connector assembly taken along line A-A in FIG. 2.
Figure 9:
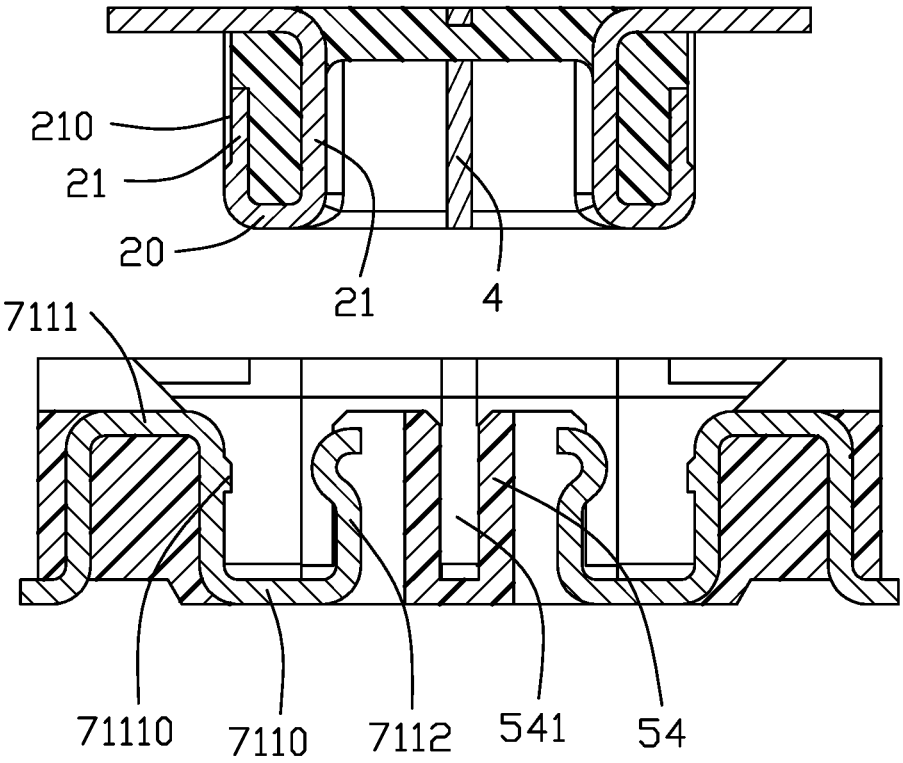
FIG. 9 is a cross-sectional view of the electrical connector assembly taken along line B-B in FIG. 2.
Figure 10:
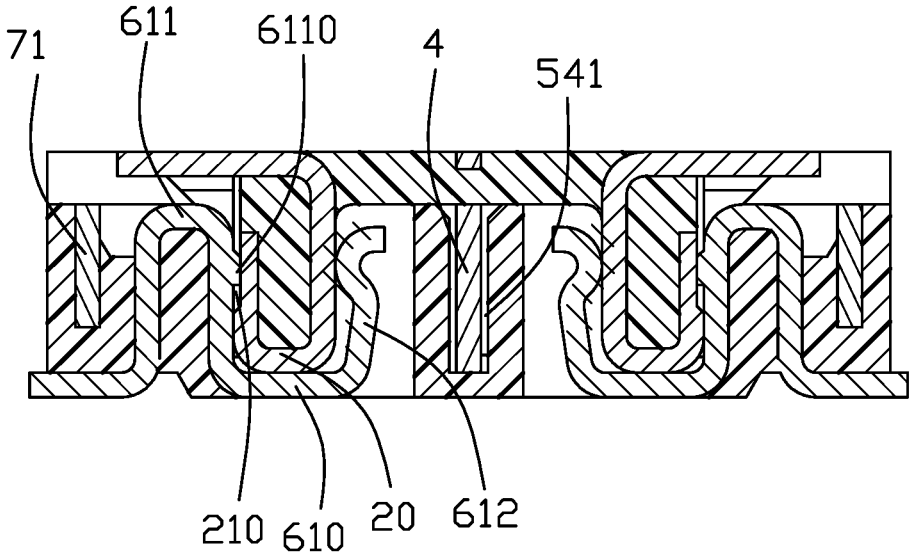
FIG. 10 is a cross-sectional view of the electrical connector assembly taken along line C-C in FIG. 1.
Figure 11:
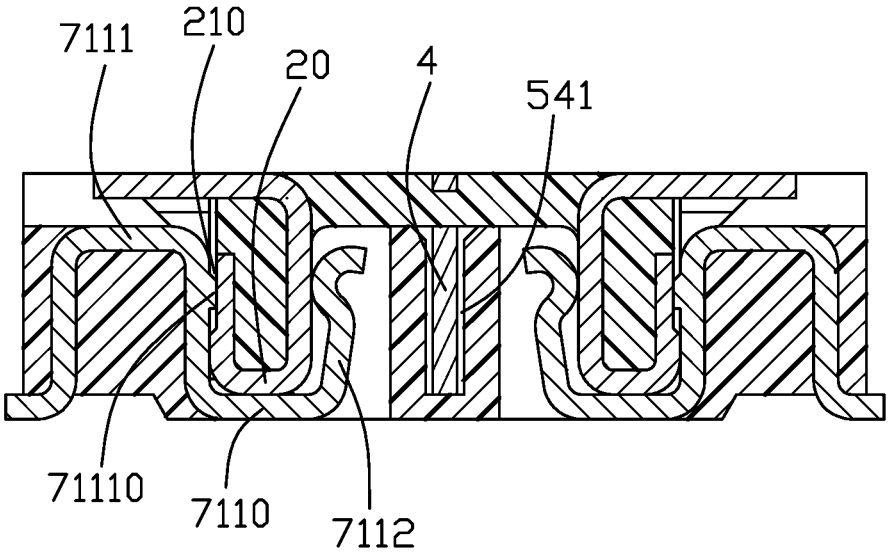
FIG. 11 is a cross-sectional view of the electrical connector assembly taken along line D-D in FIG. 1.
Figure 12:
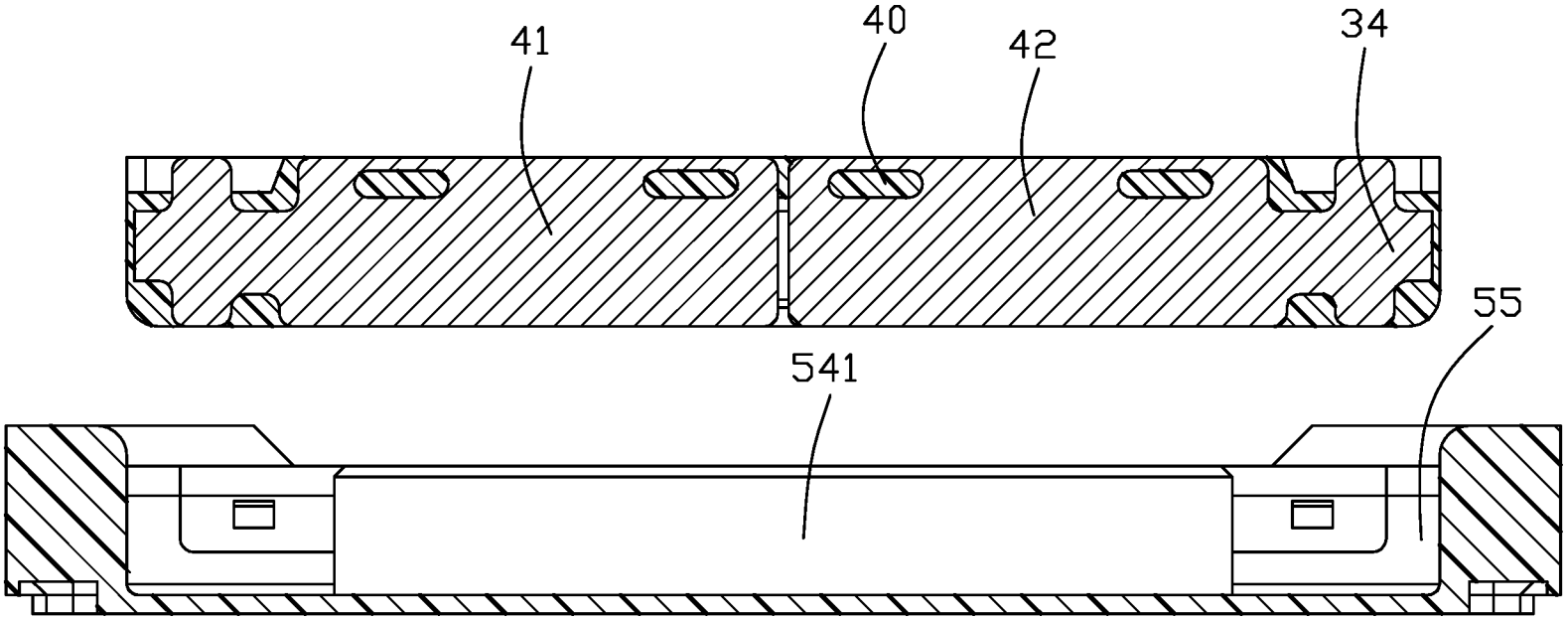
FIG. 12 is a cross-sectional view of the electrical connector assembly taken along line E-E in FIG. 2.
Figure 13:
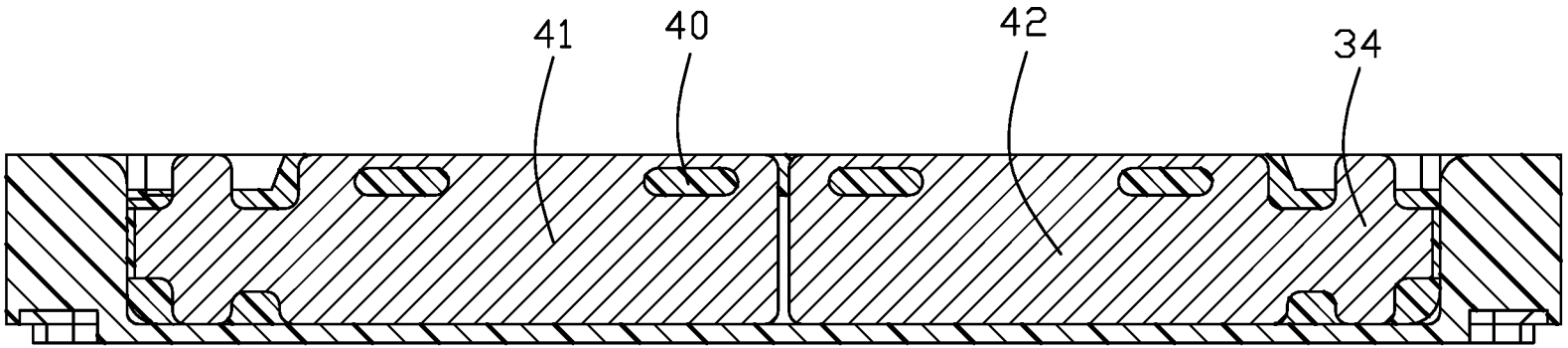
FIG. 13 is a cross-sectional view of the electrical connector assembly taken along line F-F in FIG. 1.

As shown in FIGS. 4 and 5, in the plug connector 100 the holding member 3 includes an end plate 35 secured to an end face of the end wall 12 and spanning perpendicular to the longitudinal direction so as to allow the coupling portion 34 to e unitarily extend from a lateral side edge of the end plate 35, a horizontal plate 36 secured to a top face of the end wall 12 and spanning perpendicular to the vertical direction so as to allow the end plate 35 to unitarily extending from an edge of the horizontal plate 36, and a vertical plate 37 linked with the horizontal plate 36 and extending in a vertical plane perpendicular to the transverse direction, wherein the grounding contact 201 unitarily extends sidewardly from the vertical plate 37. Understandably, because the contacting limb and the soldering part 22 of the grounding contact 201 associated therewith are commonly bent from an upper edge thereof in a folded manner, and the grounding contact 201, the holding member 3 and the shielding plate 4 are unified together and derived from a same sheet metal, the coupling portion 34 is required to extend from the end plate 35 rather than from the horizontal plate 36; otherwise, no sufficient material of such a sheet metal can fulfill the configuration of the combination of the shielding plate 4, the coupling portion 34, the end plate 34, the horizontal plate 36, the vertical plate 34 and the corresponding grounding contact 201. This is also another feature of the invention.

What is claimed is:

1. An electrical connector comprising:

an insulative housing defining a receiving space;

a plurality of contacts secured to the insulative housing and exposed to the receiving space;

a first and second holding members secured to two opposite ends of the insulative housing and exposed to the receiving space; and a shielding plate located between the first and second holding members; wherein at least one of the first and second holding members has an integral coupling portion parallel to and coupled to the shielding plate; and the shielding plate is coplanar with the coupling portion.

2. The electrical connector as claimed in claim 1, wherein each holding member has two separate parts with one part thereof being coupled to the shielding plate by an associated coupling portion.

3. The electrical connector as claimed in claim 1, wherein the shielding plate comprises a first shield and a second shield separated from the first shield, the first shield is coupled to the first holding member, and the second shield is coupled to the second holding member.

4. The electrical connector as claimed in claim 1, wherein the shielding plate is coupled to both the first holding member and the second holding member.

5. An electrical connector assembly comprising:

a plug connector including:

an insulative plug housing defining a pair of side walls along a longitudinal direction to commonly define a receiving space therebetween in a transverse direction perpendicular to the longitudinal direction, said receiving space being exposed to an exterior in a vertical direction perpendicular to both the longitudinal direction and the transverse direction;

a plurality of plug contacts secured to the corresponding side walls with contacting limbs facing toward the receiving space in the transverse direction, respectively;

a pair of metallic holding members secured to two opposite longitudinal ends of the plug housing in said longitudinal direction; and a metallic shielding plate set located at a longitudinal centerline of the housing, extending along the longitudinal direction, and unitarily extending from at least one of said pair of holding members and communicatively exposed toward the pair of side walls in the transverse direction; wherein the at least one holding member includes a coupling portion directly linked to the shielding plate set, an end plate linked to the coupling portion sidewardly, secured to an end face of the housing, and spanning perpendicular to the longitudinal direction, a horizontal plate linked to the end plate, secured to a top face of the housing, and spanning perpendicular to the vertical direction, and a vertical plate linked to the horizontal plate, secured to the corresponding side wall, and spanning perpendicular to the transverse direction.

6. The electrical connector assembly as claimed in claim 5, wherein said plug contact is undeflectable.

7. The electrical connector assembly as claimed in claim 6, wherein the metallic shielding plate set includes two spaced shielding plates respectively unitarily extending from the pair of holding members.

8. The electrical connector assembly as claimed in claim 7, wherein each holding member is constructed of a first part and a second part spaced from each other with a gap in the transverse direction, and the shielding plate is unitarily formed with one of said first part and said second part.

9. The electrical connector assembly as claimed in claim 8, wherein one shielding plate is unitarily formed with the first part of one holding member while the other shielding plate is unitarily formed with the second part of the other holding member so as to have the corresponding two gaps not aligned with each other in the longitudinal direction.

10. The electrical connector assembly as claimed in claim 9, wherein in each holding member, each of the first part and the second part forms a corresponding plug contact.

11. The electrical connector assembly as claimed in claim 5, wherein the plug connector further includes one grounding contact unitarily extending sidewardly from the vertical plate, and the grounding contact includes a contacting limb and an associated horizontal soldering part therewith to commonly extend from an upper edge thereof in a folded manner.

12. The electrical connector assembly as claimed in claim 11, wherein each holding member includes a first part and a second part space from each other with a gap therebetween in the transverse direction, and the first part and the second part are similar to each other except that the first part is linked to the shielding plate set while the second part is not.

13. The electrical connector assembly as claimed in claim 5, further including a receptacle connector, said receptacle connector including:

an insulative receptacle housing having a pair of side walls extending along the longitudinal direction and spaced from each other with a receiving cavity and a center island therebetween in the transverse direction, a receiving slit in a longitudinal centerline of the center island; and a plurality of receptacle contacts secured to the corresponding side walls of the receptacle housing with corresponding deflectable contacting parts extending toward the center island in the transverse direction, respectively; wherein during mating, the center island of the receptacle connector is received within the receiving space of the plug connector, the pair of side walls of the plug housing are receive within the receiving cavity of the receptacle connector, the plug contacts are mated with the corresponding receptacle contacts, respectively, and the shielding plate set is received within the receiving slit.

14. The electrical connector assembly as claimed in claim 13, wherein the receptacle connector further includes a metallic shielding shell secured to the receptacle housing, and the shielding shell includes a pair of side parts each forming unitarily a plurality of resilient ground contacts alternately arranged with the corresponding receptacle contacts along the longitudinal direction.

15. The electrical connector assembly as claimed in claim 14, wherein each side part essentially continuously extends a full length of the corresponding side wall of the receptacle housing along the longitudinal direction, and unitarily connected to a corresponding end part.

16. The electrical connector assembly as claimed in claim 15, wherein each of side part and said end part has one horizontal solder leg.

17. A metal sub-assembly for use with an electrical connector including an insulative housing defining a pair of side walls along a longitudinal direction to commonly define a receiving space therebetween in a transverse direction perpendicular to the longitudinal direction, said receiving space being exposed to an exterior in a vertical direction perpendicular to both the longitudinal direction and the transverse direction, said metal sub-assembly comprising:

a metallic holding member adapted to be secured to an longitudinal end of the housing in said longitudinal direction; and a metallic shielding plate set located at a longitudinal centerline of the housing, extending along the longitudinal direction, and unitarily extending from said holding member for being communicatively exposed toward the pair of side walls of the housing in the transverse direction; wherein the holding member includes a coupling portion directly linked to the shielding plate set, an end plate linked to the coupling portion sidewardly and spanning perpendicular to the longitudinal direction, a horizontal plate linked to the end plate and spanning perpendicular to the vertical direction, and a vertical plate linked to the horizontal plate and spanning perpendicular to the transverse direction.

18. The metal sub-assembly as claimed in claim 17, further including one grounding contact unitarily extending sidewardly from the vertical plate, and said grounding contact includes a contacting limb and a horizontal soldering part associated therewith to commonly extend from an upper edge thereof in a folded manner.

* * * * *